United States Patent [19]

Hanzawa

[11] Patent Number: 4,767,376

[45] Date of Patent: Aug. 30, 1988

[54] TOY VEHICLE

[75] Inventor: Tsuneo Hanzawa, Tokyo, Japan

[73] Assignee: Hanzawa Corporation, Tokyo, Japan

[21] Appl. No.: 923,628

[22] Filed: Oct. 27, 1986

[30] Foreign Application Priority Data

Oct. 29, 1985 [JP] Japan ..... 60-165175

[51] Int. Cl.[4] ..... A63H 29/00; A63H 29/20

[52] U.S. Cl. ..... 446/457; 446/396; 446/462

[58] Field of Search ..... 446/396, 431, 437, 456, 446/457, 462, 464, 465, 470

[56] References Cited

U.S. PATENT DOCUMENTS

| | | | |
|---|---|---|---|
| 1,363,891 | 12/1920 | Lovington | 446/6 |
| 2,597,094 | 5/1952 | Gutmann | 446/6 |
| 2,677,216 | 5/1954 | Hein | 446/462 |
| 3,733,744 | 5/1973 | Hiltpold et al. | 446/459 |
| 3,748,780 | 7/1973 | Glass et al. | 446/464 |
| 3,769,746 | 11/1973 | Prodger et al. | 446/459 |
| 3,772,824 | 11/1973 | Terzian et al. | 446/437 |
| 3,816,958 | 6/1974 | Winston | 446/462 |
| 3,914,898 | 10/1975 | Ferguson | 446/470 |
| 3,947,033 | 3/1976 | Bennett | 446/470 |
| 4,201,011 | 5/1980 | Cook | 446/440 |
| 4,290,228 | 9/1981 | Goldfarb et al. | 446/456 |
| 4,309,841 | 1/1982 | Asano | 446/440 |
| 4,400,908 | 8/1983 | Nomura | 446/396 |
| 4,443,967 | 4/1984 | Jones et al. | 446/462 |
| 4,479,327 | 10/1984 | Wakimura | 446/462 |
| 4,490,124 | 12/1984 | Ogawa | 446/464 |
| 4,562,893 | 1/1986 | Cunard | 446/465 |
| 4,591,158 | 5/1986 | Samson et al. | 446/456 |
| 4,591,346 | 5/1986 | Ikeda | 446/437 |
| 4,601,674 | 7/1986 | Koizumi | 446/462 |

FOREIGN PATENT DOCUMENTS

| | | | |
|---|---|---|---|
| 0151250 | 8/1985 | European Pat. Off. | 446/456 |
| 2205451 | 8/1973 | Fed. Rep. of Germany | 446/470 |
| 2713578 | 5/1978 | Fed. Rep. of Germany | 446/470 |
| 1110498 | 2/1956 | France | 446/465 |
| 1537342 | 12/1978 | United Kingdom | 446/462 |
| 1557404 | 12/1979 | United Kingdom | 446/462 |

*Primary Examiner*—Robert A. Hafer
*Assistant Examiner*—Charles H. Harris
*Attorney, Agent, or Firm*—Gausewitz, Carr & Rothenberg

[57] ABSTRACT

A self-righting flywheel motor operated toy vehicle includes attitude restoration components at the rear thereof, the vehicle having the center of gravity thereof along the longitudinal centerline thereof. A first component includes an attitude restoration plate configured in the form of a spoiler member attached at the rear of the vehicle above the rear wheels and having a width greater than the distance between the outer sides of the wheels for enabling the maintaining of a slight elevational angle of the vehicle when on either side, with a corner of the driving wheel on that side in contact with the surface. The force of the driving wheel tends to self-right the vehicle. The second component includes an elongate somewhat rigid, yet flexible wire member configured to simulate a whip antenna, which is connected to the chassis at a corner thereof at about the rear surface of the rear wheels, and positioned for coaction of an intermediate portion thereof with the spoiler member as the vehicle attempts to scale a generally vertical surface. The resilience during partial deformation of the wire member serves to keep the driving wheels in contact with the surface. As the driving continues, the vehicle turns to one side or the other, and by itself, or with the assistance of the first component, self-rights itself.

13 Claims, 2 Drawing Sheets

TOY VEHICLE

BACKGROUND OF THE INVENTION

The background of the invention will be discussed in two parts.

1. Field of the Invention

This invention relates to toy vehicles, and more particularly, an inertia wheel driven, self-righting toy vehicle.

2. Description of the Prior Art

Toy vehicles have been a constant source of amusement for children. Such toy vehicles are usually configured to depict actual vehicles, such as sedans, trucks, racing vehicles and off-road vehicle. The amusement associated with such vehicles may be ehanced by providing some additional element of action. Some such toy vehicles have been provided with motive means, from spring wound motors, to electrical motors, and inertia wheel driven propulsion motors.

One such vehicle is shown an described in U.S. Pat. No. 1,363,891, entitled "Toy Vehicle", which issued on Dec. 28, 1980 to Lovington. The vehicle is constructed to collapse the chassis and release the front wheel assembly on impact of the front bumper mechanism with an object.

Another such vehicle is shown in U.S. Pat. No. 2,597,094, entitled "Impact Operated Toy", which issued to Gutmann, on May 20, 1952. On impact with an object by the front bumper mechanism, the normally latched vehicle chassis and body parts hinge to different positions to simulate a wrecked vehicle.

A flywheel propulsion unit for a toy vehicle is shown and described in U.S. Pat. No. 2,677,216, issued May 4, 1954 to Hein, entitled "Flywheel Propelled Toy Vehicle."

Another motive means for a toy vehicle is shown and described in U.S. Pat. No. 3,733,744, issued to Hiltpold et al on May 22, 1973 for "Power Module for Driving Vehicle-Propelling Element, Including Stationary Axle Means Mounting Said Element." The power module includes an electrical motor and a rechargeable battery.

An elastic band powered vehicle is shown and described in U.S. Pat. No. 3,769,746, issued on Nov. 6, 1973 to Prodger et al, such patent being entitled "Rubber Band Drive for Toy Vehicle", the vehicle having a rearwardly extending actuating member which may be frictionally engaged upon a surface for rotating the same to store energy in the rubber band.

U.S. Pat. No. 3,816,958, issued June 18, 1974 to Winston, for a "Wheel Drive Toy", and shows a toy vehicle with an inertia wheel used as the drive wheel with a second wheel member coupled to the first through a gear train, the second wheel protruding from the top of the vehicle for engagement with a surface for enabling rotation of the inertia wheel to a higher speed through the gear train, whereupon the vehicle is placed right side up on a surface for movement.

Another type of action for a toy vehicle is shown in U.S. Pat. No. 3,914,898, entitled "Spoiler-Jack for Vehicle Toy", issued to Ferguson on Oct. 28, 1975. In this patent there is shown a toy vehicle with a spoiler, which is pivotable between first and second positions, the first being above the vehicle to simulate a spoiler, and the second being below the vehicle to act as a vehicle jack for elevating the rear of the vehicle.

A "Toy Motorcycle" with a flywheel motor means is shown in U.S. Pat. No. 4,201,011, issued to Cook on May 6, 1980. Another motorcycle toy is shown in U.S. Pat. No. 4,309,841, entitled "Two-Wheel Toy Vehicle with Inertia Flywheel", which issued to Asano on Jan. 12, 1982. In this vehicle, the rear thereof is provided with means configured on the rear fender engageable with a surface for enabling propulsion on the rear wheel with the front wheel off the surface, thus providing a simulated "wheelie" action.

A stunt type toy vehicle is shown and described in U.S. Pat. No. 4,400,908, entitled "Miniature Vehicle Action Toy", which issued to Nomura on Aug. 30, 1983. The vehicle is in the form of a car with an inertia powered motor, the exterior of the vehicle being provided with a rotating element with a central pin member, driven by the motor. The vehicle may be positioned on the pin and rotated like a top.

U.S. Pat. No. 4,443,967, issued to Jones et al on Apr. 24, 1984, and is entitled "Flywheel Driven Toy Car". This vehicle includes a flywheel which serves as a drive wheel. A pad is provided at the rear of the vehicle for enabling tilting of the vehicle to lift the flywheel from engagement with a surface with the rear wheels of the vehicle in contact with the surface. Movement of the vehicle in the tilted position rotates the rear wheels which rotate the flywheel for storage of energy therein, after which pressure is removed form the rear to lower the vehicle for propulsion on a surface.

A somersaulting toy vehicle is shown and described in U.S. Pat. No. 4,490,124, entitled "Running Toy", which issued to Ogawa on Dec. 25, 1984. In this vehicle, a pivotable spring biased plate member is coupled beneath the vehicle, and is normally latched against the force of its bias out of engagement with the surface on which the vehicle operates. In response to the motion of part of the motor assembly, the member is actuated to somersault the vehicle, whereupon the vehicle lands in its original orientation, and continues its movement along the surface.

Another toy vehicle with a device for restoring a tipped vehicle to its wheels is described in Japanese Utility Model Laid-open Publication No. 60-92588, which shows and describes a mechanism for restoring the attitude of a tipped car body, and consists of an attitude restoring supporting member extending from one side of the car body, which member serves to make contact with the floor when the running car falls on its side, thereby keeping the underside driving wheel in contact with the floor so as to allow the car to recover its horizontal attitude by itself.

However, with this prior art toy automobile, the attitude restoration possibility is limited only the tipping of the vehicle to the one side with the restoring member. In addition, since the extra supporting member lacks any resemblance to an actual vehicle component or attachment, the toy vehicle lacks the simulation of the characteristics and appearance of an actual vehicle, thus detracting from the play value.

The toy vehicles of the above patents are representative of the state of the art of toy vehicles with propulsion or action assemblies.

It is an object of the present invention to provide a new and improved toy vehicle with an inertia wheel drive with provision for self righting the vehicle.

SUMMARY OF THE INVENTION

The foregoing and other objects of the invention, in accordance with an embodiment of the invention, are accomplished by providing an inertia motor operated toy vehicle with components at the rear thereof which components simulate actual vehicle attachments. The vehicle simulates an off-road four wheel drive racing type vehicle, with the center of gravity of the motor and vehicle along the longitudinal centerline thereof. A first component includes an attitude restoration plate configured in the form of a spoiler member attached at the rear of the vehicle above the rear wheels and having a width greater than the distance between the outer sides of the wheels for enabling the maintaining of a slight elevation of the vehicle when on either side, with a corner of the driving wheel on that side in contact with the surface. The force of the driving wheel tends to self-right the vehicle. The second component includes a wire member configured to simulate a whip antenna, and is secured to the rear of the vehicle adjacent a corner therof, the component being formed of an elonate somewhat rigid, yet flexible wire member configured to simulate a vertically extending whip antenna. The wire member is connected to the frame slightly rearwardly of the rear surface of the rear wheels, and positioned for coaction of an intermediate portion thereof with the spoiler member as the vehicle attempts to scale a generally vertical surface. The resilience during partial deformation of the wire member serves to keep the driving wheels in contact with the surface. As the driving continues, the vehicle turns to one side or the other, and by itself, or with the assistance of the first component self-rights itself.

Other objects, features and advantages of the invention will become apparent from a reading of the specification, when taken in conjunction with the drawings, in which like reference characters refer to like elements in the several views.

DETAILED DESCRIPTION OF THE PREFERRED EMBODIMENT

Figure 1:
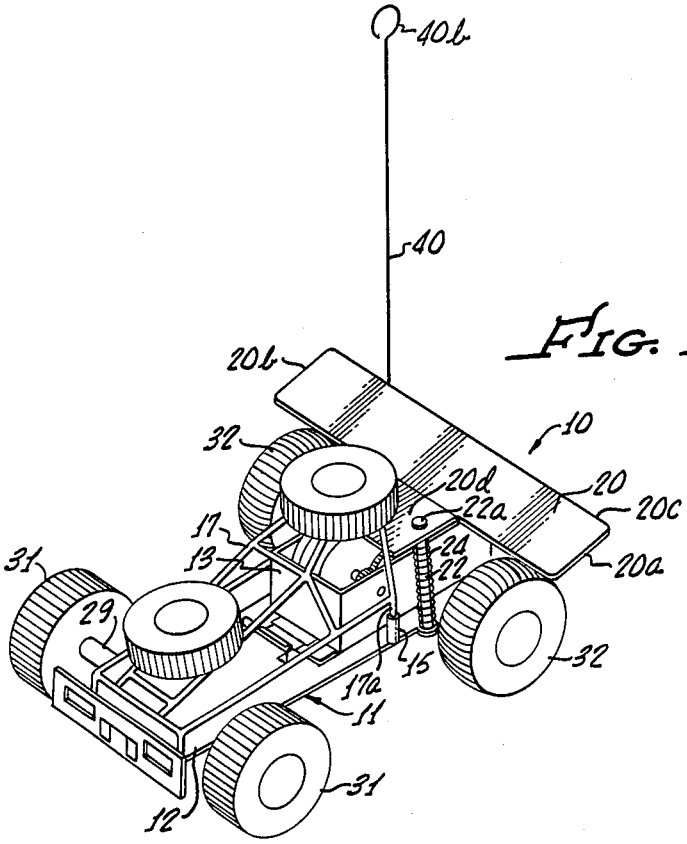
FIG. 1 is a perspective view of the toy vehicle according to the invention.
Figure 2:
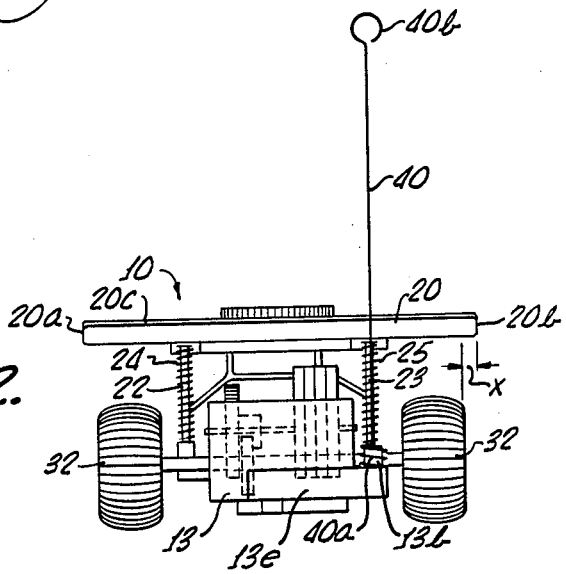
FIG. 2 is a rear view of the toy vehicle of FIG. 1.
Figure 3:
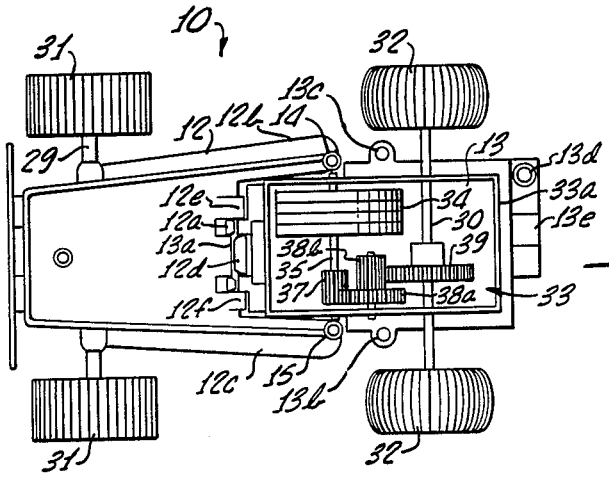
FIG. 3 is a plan view of the toy vehicle of FIG. 1 with with the body removed.

Referring now to the drawings, and particularly to FIGS. 1, 2 and 3, there is shown a toy vehicle, generally designated 10, configured to simulate a four wheel drive or rear wheel drive off-road racing vehicle. The vehicle 10 includes a vehicle chassis, generally designated 11, which consists of molded plastic front and rear chassis sections 12, and 13, respectively, each of which is generally plate shaped and configured for hinged couplings. As best illustrated in FIG. 3, the front chassis section 12 has a U-shaped cutaway portion defined by a lateral edge 12*a* and first and second rearwardly extending arm portions 12*b* and 12*c* which terminate in upwardly extending aperture boss portions 14 and 15.

For the hinged couplings, the edge 12*a* is provided with couplings means in the form of a lower centrally disposed, rearwardly extending tab member 12*d*, with a pair of offset rearwardly extending upper tab members 12*e* and 12*f* configured for receiving a pivot shaft 13*a* therebetween, the shaft 13*a* being secured to the forward end of the rear chassis section 13. The center tab member has an enlarged detent type end for captively retaining the shaft 13*a* thereon. This interconnection provides relative pivotable movement between the front and rear chassis 12 and 13.

A body 17, configured in the form of a "roll cage" is fixedly attached to the front chassis 12 only, by suitable connection (not shown) at the front end of chassis 12 and insertion of the downwardly depending rear tubular members 17*a* (only one of which is shown) into the apertured bosses 14 and 15 at the terminal ends of arm portions 12*b* and 12*c*.

Affixed to, and as part of the body 17, at the upper rear thereof, there is attached a first attitude restoration component in the form of a plate member 20, configured to simulate an air spoiler. The plate member 20 is positioned generally above the rear wheels 32 in generally spaced alignment with the axle 30, and the main surface thereof is rearwardly upwardly sloping relative to a surface 44 on which the vehicle 10 rests. For reasons which will be discussed hereinafter, and as best shown in FIG. 2 (See also FIGS. 1 and 4), the terminal lateral edges 20*a* and 20*b* of the plate member 20 are in generally parallel relation and extend beyond the width of the rear wheels 32 of the vehicle 10 an equal distance on both sides, this distance being designated "X". Also as shown in FIG. 5, the rear edge 20*c* is approximately aligned in a vertical direction with the rearward extremity of the wheels 32.

The forward projection 20*d* of the plate member 20 includes first and second apertures for loosely and slidably receiving therethrough the upper ends of shafts or rod members 22 and 23 which have enlarged head portions 22*a* (only one of which is shown) above the projection 20*d* of plate member 20, with the lower ends of which are secured in apertured bosses 13*b* and 13*c* integrally formed in the upper surface of rear chassis section 13. First and second coil springs 24 and 25 encircle the shafts or rod members 22 and 23, respectively, with the springs 24 and 25 in compression to act as buffers or shock absorbers during relative pivotable movement of the chassis sections 12 and 13. Thus, the body 17 is secured to the front chassis section 12 and the air spoiler member 20 is secured to, and fixed relative to, the front chassis section 12 by means of the body 17. The front and rear chassis sections 12 and 13 are then interconnected by virtue of the pivotal coupling via shaft 13*a* and the spring suspension afforded by rod members 22, 23 and coil spring members 24, 25. This interconnection thus provides spring suspension for the vehicle 10.

Front and rear chassis sections 12 and 13, respectively, rotatably support front and rear wheel shafts 29 and 30, on opposite ends of which are attached right and left, generally identically dimensioned front and rear wheels 31 and 32 of all the same diameter, with the spacing between wheels of the front and rear sets being generally identical. The wheels 31 and 32, in accordance with conventional toy vehicles, are adapted for contact with a surface on which the vehicle 10 may be driven, with both rear wheels being fixedly attached to the axle 32 for concurrent driving.

The rear chassis section 13 is configured to provide means for coupling thereto a motor means or a power module, in the form of a flywheel mechanism generally designated 33. The rear chassis section 13 has four upwardly extending peripheral wall portions defining a rectangular box-like structure 33*a*, the walls thereof being arranged to support shafts or axles required for the mechanism 33. An inertia wheel or flywheel 34 is rotatably supported on a shaft 35 affixd thereto, with shaft 35 being rotatably supported between opposing sidewalls of the structure 34*a*. The other end of shaft 35 has secured thereto for rotation therewith a pinion gear drive member 37. An intermediate gear member 38 is provided with a larger diameter gear portion 38*a* in meshing engagement with drive gear member 37, and a coaxial pinion gear portion 38*b*. The pinion gear portion 38*b* is in meshing engagement with a large diameter gear member 39 which is fixed to axle 30 of the rear wheel drive assembly. The drive mechanism 33 is arranged on rear chassis 13 with its center of gravity C.G. (See FIG. 4) positioned on the longitudinal centerline of the vehicle 10. With such inertia powered vehicles, the parts are arranged so that the vehicle 10 may be operated by contacting the drive or rear wheels 32 with a surface and pushing the vehicle 10 in a given direction, one or more times, thus rotating flywheel 34 by means of the gear train, and thus storing kinetic energy in flywheel 34. The kinetic energy is then released when the vehicle 10 is freely left on the surface on all four wheels, with driving rear wheels 32 frictionally engaging the surface to drive the toy vehicle 10. It is to be understood that the two rear wheels 32 are fixedly attached to the ends of axle 30 so that contact of only one of the rear wheels 32 with the surface, likewise effects motion of the vehicle 10.

At the rear part of rear chassis section 13, somewhat offset in the vehicle width direction, and rearwardly of the structure 33*a*, there is an upwardly extending projection 13*d* formed on a rearwardly extending portion 13*e* of rear chassis section 13. As shown in FIG. 3, this projection 13*d* is in alignment with, or just rearwardly of a line drawn through the rearmost part of the circumference of rear wheels 32. A second attitude restoration component or member 40, configured to simulate a whip antenna, has the lower end 40*a* thereof coiled for frictional engagement with the outer periphery of projection 13*d* for retention thereon. The other upper extremity of member 40 is configured in the form of a loop 40*b*. The wire member 40 extends in a generally vertical direction, that is perpendicular to the plane of the chassis formed of sections 12 and 13, and is formed of a resilient or flexible, yet somewhat rigid wire, preferably a spring steel type wire.

Figure 4:
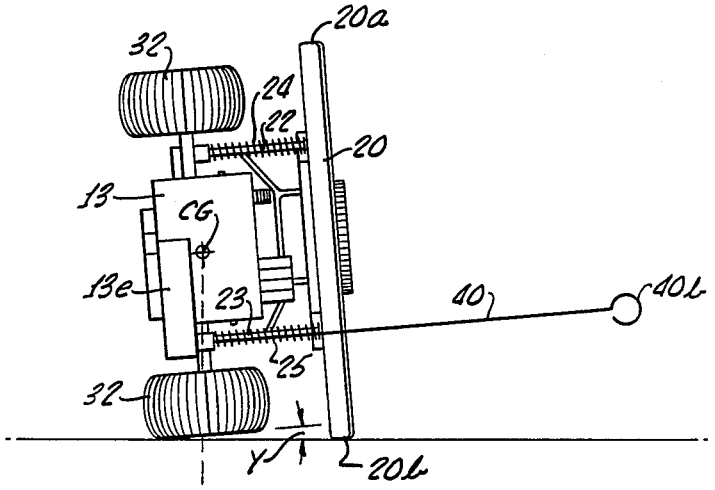
FIG. 4 is a side view showing the toy vehicle fallen or on one side with the air spoiler member maintaining a corner of a rear wheel in driving contact.
Figure 5:
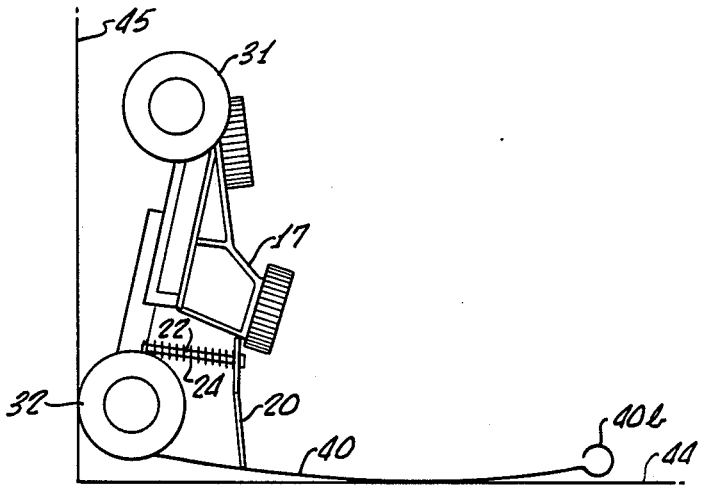
FIG. 5 is a simplified side view of the toy vehicle with the simulated antenna wire member maintaining the drive wheels in contact with a vertical surface just prior to overturning of the vehicle to the horizontal surface.

Referring now also to FIGS. 4 and 5, the operation of the vehicle with the first and second attitude restoration components 20 and 40 will be described. With a toy vehicle 10 constructed as described above, with flywheel 34 storing kinetic energy, the vehicle 10 is put on a surface with the front and rear wheels 31 and 32 in contact with the surface. The hand is then removed from the vehicle body 17, whereupon the flywheel 34 delivers the stored kinetic energy to flywheel drive shaft 35 via drive gear 37, gear member portion 38*a*, pinion gear portion 38*b* and driven gear 39 to drive rear wheels 32 to propel the vehicle 10.

During driving, if the vehicle 10 tips or falls on its right or left side, the right or left end 20*a*, 20*b* of attitude restoration plate member 20 makes contact with the surface, as shown in FIG. 4. With the ends 20*a* and 20*b* of attitude restoration plate member 20 extending beyond the width of the rear wheels 32, as shown in FIG. 4, the wheel 32 is at an angle to the surface 44 with the end 20*b* in contact with the surface 44. Consequently, the lower edge of the rear driving wheel 32 on the same side as end 20*b* remains in frictional engagement or contact with the surface 44. With the wheel 32 being driven by the flywheel mechanism 33 and the wheel 32 rotating in a forward direction, the inertial reaction of this contact, coupled with the center of gravity (designated "C.G." in FIG. 4) of the flywheel mechanism 33 on the longitudinal centerline of the vehicle 10 tends to act as a restoring force to self-right the vehicle 10. The restoring force is attributable to a combination of the location of the center of gravity C.G. of the flywheel mechanism 33; the shape, dimension and position of the attitude restoration plate member 20; and the angle of the wheel 32 relative to the surface 24, this angle being designated "Y" in FIG. 4, which is formed as a result of the distance "X" of overhang of the end 20*b* relative to the extreme end of the width of wheel 32. In essence, the plate member 20 is positioned generally above the wheels 32 with the plane thereof at an angle to horizontal (as viewed in FIG. 1), with the edges 20*a* and 20*b* parallel to one another and extending out from the extremity of the width of the rear driving wheels 32. Rotation of the wheel 32 in contact with the surface 44 tends to rotate the vehicle 10 about a pivot formed by the contact of edge 20*b* with surface 24. This rotation is resisted by the length of edge 20*b* in contact with the surface 44, with the angular orientation of the plate member 20 partially assisting in resistance to turning. The location of the center of gravity C.G. of flywheel mechanism 33 provides a lever arm of force which acts in a direction to self right the tipped vehicle 10, with the combination of all forces thus self-righting the vehicle 10.

On the other hand, when the vehicle 10 makes a frontal collision with a vertically extending surface or upright wall 45, as depicted in FIG. 5, the force of the driving wheels 32 cause the front wheels 31 to contact the wall 45. This driving force thereafter causes the vehicle 10 to tend to assume a vertical position, that is, to tend to climb the wall 45. At a certain point, the vertical lift of the front wheels 32 along the wall 45 will place the vehicle 10 in a position or attitude at which the attitude restoration wire member 40 comes in contact with the horizontal surface 44. Thereafter, the force of the driving wheels 32, combined with the contact of the wire member 40 with the surface 44, tends to cause the vehicle 10 to scale the wall 44 until vehicle 10 is in a generally vertical position or attitude shown in FIG. 5, at some point just prior to vehicle 10 turning over.

As can be seen, as the vehicle 10 rises to the vertical attitude, the member 40 comes in contact with the horizontal surface 44, whereupon it commences to elastically deform so that its elastic restoring force, or spring bias, for a short period, tends to maintain one or both rear wheels 32 in contact with the wall 45. The loop end 40*b* of the member 40 may likewise come in contact with the horizontal surface 44 to assist in this action. Further movement of the vehicle 10 on the wall 45 causes the rear edge 20*c* of the plate member 20 to come in contact with the wire member 40 as shown in FIG. 5. At this point, the vehicle is supported generally vertically on a line in the horizontal plane, which is the line of the wire member 40 in contact with the surface 44. This line is offset from the longitudinal centerline of the vehicle 10 due to the offset of wire member 40 on rear chassis section 13 (See FIG. 2).

At some point, instability occurs as a consequence of which the vehicle 10 will turn left or right relative to its vertical orientation. As the vehicle 10 drops to the horizontal surface 44, it may land on all four wheels, but in most instances, it will tip to one side or the other and assume the tipped position shown in FIG. 4, after which it will self-right so long as the driving wheels 32 are in motion. As can be seen, the second attitude restoration wire member 40 must be sufficiently rigid, yet sufficiently flexible to perform its intended function. The controlled deformation or flexing of the member 40 serves to act as a spring bias in maintaining the wheels 32 in contact with the vertical wall 45, and prevents the simultaneous detachment of right and left rear wheels 32 from the wall 45, or serves to bring the rear wheels 32 into contact after a short detachment, to allow the toy vehicle 10 to return to its normal attitude by subsequently causing the attitude restoration plate member 20 to make contact with the surface 44 on its edge **20*b* (See FIG. 4). In this regard, although the wire member 40 may perform the restoration motion even when it is installed at the middle point of the rear of the width of the vehicle 10, the offset location as in this embodiment is more reliable in bringing the vehicle 10 into the position or attitude shown in FIG. 4, because an offset position is more conductive to causing twisting of the vehicle 10**.

In accordance with the present invention, there has been shown and described a toy vehicle 10 having first and second attitude restoration components, in the form of a spoiler-simulating plate member 20 and a whip antenna-simulating wire member 40, so dimensioned, arranged and configured relative to the vehicle 10 configuration, to effect self-righting of the vehicle 10 when tipped to one side and to effect self-righting in the event the vehicle 10 attempts to scale a generally vertical surface 45, such self-righting occurring so long as the rear drive wheels 32 are rotating under force of the flywheel mechanism 33. Alternatively stated, the wire member 40 is so dimensioned and positioned for contact with a horizontal surface 44 with the vehicle 10 attempting to scale a generally vertical surface 45 for assisting in maintaining at least one of the rear drive wheels 32 in contact with the vertical surface 45 until the vehicle 10 pivots from a generally vertical attitude about an axis defined by the wire member 40. In either instance, the vehicle 10 can automtically restore its horizontal attitude to resume driving. Furthermore, since the attitude restoration plate 20 is configured to simulate an air spoiler, and the attitude restoration elastic wire member 40 is configured to resemble a car radio whip antenna, both attitude restoration members have a familiar appearance resembling true equipment of actual off-road racing cars, thus providing realism to the toy vehicle 10, while giving the user the enjoyment of well simulated car racing.

While there has been shown and described a preferred embodiment, it is to be understood that various other adaptations and modifications may be made within the spirit and scope of the invention.

What I claim is:

1. A toy vehicle comprising:

chassis means having a longitudinal centerline in the direction of travel of the vehicle;

at least one pair of rear drive wheels coupled to said chassis means;

motor means on said chassis means coupled for simultaneously driving said drive wheels, said motor means having the center of gravity thereof lying generally along the longitudinal centerline of said chassis means;

a first attitude restoration member secured to said chassis means at a position above said rear drive wheels, said member being plate like and configured to simulate an air spoiler and having the ends thereof extending laterally beyond the outer limit of the right and left wheels in the direction lateral to the longitudinal centerline of said chassis means, said plate like member being so dimensioned, configured and arranged that with the vehicle tipped to one side on a surface, at least one of said driving wheels is in contact with the surface, the combined effect of a driven driving wheel in contact with the surface and the center of gravity of the motor means providing a restoring force to self-right the vehicle; and a second attitude restoration member, said second attitude restoration member member including a flexible yet somewhat rigid wire member having one end thereof secured to the rear portion of said chassis means intermediate said rear wheels in an orientation substantially perpendicular to the plane of the chassis means, said wire member being configured to resemble a vehicle antenna member, said wire member being so dimensioned and positioned for contact with a horizontal surface with the vehicle attempting to scale a generally vertical surface, said second attitude restoration member assiting in maintaining at least one of said rear drive wheels in contact with the vertical surface until the vehicle pivots from a generally vertical attitude about an axis defined by said wire member.

2. The toy vehicle of claim 1 in which said wire member is attached to said chassis means at a position offset from the longitudinal centerline of said chassis means.

3. The toy vehicle according of claim 1 wherein said chassis means includes front and rear chassis sections and a body structure configured to simulate a roll cage.

4. The toy vehicle according to claim 3 wherein said body structure is secured to said front chassis section, said rear chassis section has an edge thereof pivotably coupled to a rear edge of said front chassis section, said plate like member is secured to said body structre, and said rear chassis section is interconnected with said plate like member by spring means.

5. In a toy vehicle having a pair of rear driving wheels rotatably supported on vehicle body means, the combination comprising:

motor means coupled to the vehicle body means for providing rotational power to both rear driving wheels of the toy vehicle;

an air-spoiler-like attitude restoration plate member attached to and located at the upper rear area of the vehicle body means, said attitude restoration plate member being located above said drive wheels and extending beyond the outer limits of the left and right rear wheels in the directions lateral to the longitudinal centerline of the vehicle; and a car-radio-antenna-like attitude restoration spring wire member, extending upwardly from the rear portion of said vehicle body means, each of said attitude restoration members being arranged and positioned for assisting in restoring the vehicle to a normal operational attitude under force of the rotational power of said driving wheels in the event the vehicle assumes an attitude other than normal.

6. The combination according to claim 5 wherein the toy vehicle has a longitudinal centerline in the direction of travel thereof, said motor means of said toy vehicle has the center of gravity thereof located generally along said longitudinal centerline.

7. The combination according to claim 6 wherein said attitude restoration wire member is offset from said longitudinal centerline.

8. The combination according to claim 5 wherein said driving wheels include a common axle, and said plate member is positioned above and in general alignment with said axle.

9. The combination according to claim 8 wherein said plate member has the rear edge thereof in generally vertical alignment with the rearmost edges of said driving wheels with said vehicle in its normal position on a surface.

10. The combination according to claim 5 wherein said wire member has one end thereof attached to the rearmost portion of said body means, said wire member extending along a line which is in proximate relation to the rearmost edges of said driving wheels.

11. In a toy vehicle having a pair of rear driving wheels rotatably supported about an axis on vehicle body means, the combination comprising:

motor means coupled to said vehicle body means for providing rotational power to both rear driving wheels of the toy vehicle;

a plate member attached to and located at the upper rear area of the vehicle body means, said plate member extending beyond the outer limits of the left and right rear wheels in the directions lateral to the longitudinal centerline of the vehicle; and a spring wire member, extending upwardly from the rear portion of said vehicle body means, each of said plate member and said spring member being attitude restoration members arranged and positioned for contact with a surface upon movement of the vehicle to other than a normal driving attitude for assisting in restoring the vehicle to a normal operational attitude under force of said driving wheels in the event the vehicle assumes an attitude other than normal.

12. The toy vehicle of claim 11 wherein said plate member has the rearmost edge thereof generally lying along a line generally parallel to the axis of rotation of the wheels and in a plane perpendicular to a surface supporting the vehicle, edges of said driving wheels is in substantially coplanar said plane.

13. The toy vehicle according to claim 12 wherein said wire member extends along a line in proximate relation to said plane.

* * * * *